US005150599A

United States Patent [19]

Wilson et al.

[11] Patent Number: 5,150,599

[45] Date of Patent: Sep. 29, 1992

[54] TREATMENT OF METAL SLABS

[75] Inventors: Geoffrey Wilson, Fulwood; Timothy J. Bradshaw, Bradway; Kenneth T. Lawson, Hathersage near Sheffield, all of England

[73] Assignee: Davy Mckee (Sheffield) Limited, Sheffield, England

[21] Appl. No.: 659,345

[22] PCT Filed: Aug. 24, 1989

[86] PCT No.: PCT/GB89/00986

§ 371 Date: Apr. 15, 1991

§ 102(e) Date: Apr. 15, 1991

[87] PCT Pub. No.: WO90/02003

PCT Pub. Date: Mar. 8, 1990

[30] Foreign Application Priority Data

Aug. 26, 1988 [GB] United Kingdom ..... 8820296
Apr. 14, 1989 [GB] United Kingdom ..... 8908448

[51] Int. Cl.[5] ..... B21J 13/02; B21B 15/00

[52] U.S. Cl. ..... 72/399; 72/407; 72/206; 72/416

[58] Field of Search ..... 72/407, 399, 394, 411, 72/206, 416, 402

[56] References Cited

U.S. PATENT DOCUMENTS

| | | | |
|---|---|---|---|
| 2,947,344 | 8/1960 | Springer | 72/411 |
| 3,597,958 | 8/1971 | Gross | 72/407 |
| 5,000,026 | 3/1991 | Pahnke | 72/402 |

FOREIGN PATENT DOCUMENTS

| | | | |
|---|---|---|---|
| 224333 | 10/1987 | European Pat. Off. . | |
| 4302 | 1/1981 | Japan | 72/407 |
| 394 | 1/1983 | Japan | 72/416 |
| 53301 | 3/1983 | Japan | 72/206 |
| 81201 | 4/1987 | Japan . | |
| 81238 | 4/1987 | Japan . | |
| 89542 | 4/1987 | Japan . | |
| 97326 | 4/1988 | Japan . | |
| 2062522 | 5/1981 | United Kingdom | 72/206 |

*Primary Examiner*—Daniel C. Crane
*Attorney, Agent, or Firm*—Lee, Mann, Smith, McWilliams, Sweeney & Ohlson

[57] ABSTRACT

A pressing machine for reducing the width of a hot metal slab has a pair of platens which are caused to engage with opposite edges of the slab to apply forces which reduce the width of the slab. This pressing action may cause buckling of the slab and to prevent, or at least reduce, the buckling, one or both of the opposite faces of the slab has a restraint provided adjacent thereto. The restraint may be in two parts connected to respective platens and arranged to allow for movement of one platen with respect to the other platen.

13 Claims, 9 Drawing Sheets

TREATMENT OF METAL SLABS

This invention relates to apparatus for reducing the width of a hot metal slab.

For the manufacture of metal strip, such as strip steel, it is becoming increasingly common to continuously cast a workpiece in the form of a slab, to cut the slab into lengths and to roll each length into strip. Because strips of different width are required, it is desirable that slabs of different width should be available. If these slabs are to be cast in a continuous casting machine, it is not convenient to have a number of moulds, each representing a slab of different width. It is desirable, therefore, to cast slabs of a limited number of widths and, where necessary, to reduce the width of the slab to a predetermined value and to subsequently roll the slab into strip.

In a method of reducing the width of a hot metal slab, which initially has a width dimension greater than its thickness dimension, the hot slab moving in the direction of its length is presented to a pressing machine by which forces are applied to the opposite edges of the slab to reduce the width dimension of the slab along its length.

Normally the slab will be of a much greater length than the region over which the forces are applied by the platens. For this reason, the slab is incremented through the pressing machine so that its width dimension is reduced stepwise along its length by repeated application of the forces. Thickening of the slab which accompanies each width reduction by the forces can produce a non-uniform cross-section if the increment is too long. This is undesirable and can be alleviated by reducing the increment to less than the length of the slab regions affected by each application of the forces. After the reduction in the width dimension of the slab, it is convenient to roll the slab between a pair of horizontal rolls of a rolling mill.

One of the disadvantages with this method of reducing the width dimension of a slab is that, if the width to thickness ratio of the slab is greater than about 3:1, the slab will tend to buckle rather than to deform when the pressure is applied to the opposite edges of the slab.

It is known to provide an anti-buckling restraint adjacent a face of a hot metal slab which is being pressed between a pair of platens of a pressing machine. The restraint is of a fixed size and is satisfactory for slabs of a particular size but, if a slab of a different size is pressed, the restraint has to be replaced with an appropriately sized restraint.

It is an object of the present invention to provide pressing apparatus in which this difficulty can be overcome.

According to the present invention, a pressing machine for reducing the width of a hot elongate metal slab comprises first and second platens engageable with respective opposite edges of a slab to apply forces thereto to reduce the width dimension of the slab and a restraint which, in use, is adjacent a face of the portion of the slab which is between the platens so as to control the buckling of the slab in the direction towards the restraint, characterised in that the platens are positioned one above the other and, in use, are engageable with respective upper and lower edges of the slab which is arranged with its width dimension substantially vertical and the dimension of the restraint in the vertical direction is variable so as to accommodate slabs which, before pressing, are of different width dimensions.

The slab may buckle sideways in one or other or both horizontal directions when the pressing forces are applied to the opposite edges. Steps are taken to either try to prevent buckling of the slab in both sideways directions, in which case a restraint is positionable adjacent each of the faces of the slab, or steps can be taken to encourage the slab to buckle in one sideways direction only and, in this case, a restraint is required adjacent that face of the slab which is facing the direction in which buckling is encouraged to take place. The restraint serves to control the amount of buckling.

In use, the or each restraint is of sufficiently rigid construction and is held in position adjacent the face of the slab so that, when buckling commences, the slab engages against the restraint and is prevented by the restraint from moving outwardly any further.

The or each restraint preferably extends substantially for the entire length of the platens so as to restrain that portion of the slab which is acted upon at any time by the platens. In one embodiment of the invention, the or each restraint is in two parts which are connected to respective platens and, in an alternative embodiment of the invention, the or each restraint comprises two or more beams arranged side-by-side between the platens and each beam has a separately operated ram associated with it which serves to displace the beam to a desired position adjacent the face of the slab and to retain it in that position.

In order that the invention may be more readily understood, it will now be described, by way of example only, with reference to the accompanying drawings, in which.

With a vertically acting pressing machine, it is possible for the pressing machine to have a fixed lower platen which engages with the lower edge of the slab and for the vertically reciprocating upper platen to engage with the upper edge of the slab. Such a pressing machine is simpler in construction than any pressing machine which is required to act on the edges of the slab when it is arranged with its width dimension horizontal.

Figure 11:
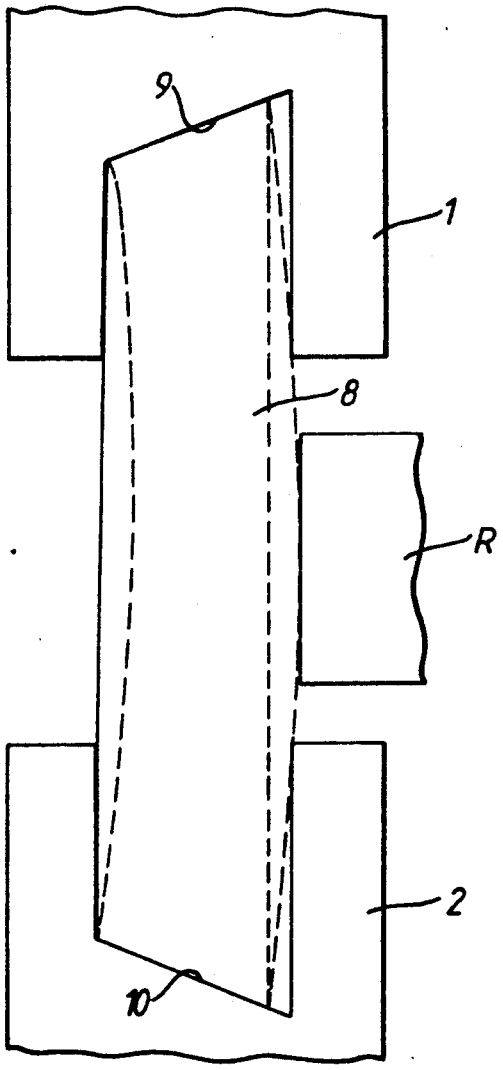
FIG. 11 shows diagrammatically an end view of a slab passing through a pressing machine which is not in accordance with the present invention.

For a broad understanding of the invention, reference is first made to FIG. 11.

Platens 1, 2 of a pressing machine are shown one above the other, Conveniently, the lower platen 2 is fixed and the upper platen 1 is movable towards and away from platen 2 but, alternatively, both platens may be movable towards and away from each other.

An elongate hot metal slab 8 is arranged with its widthwise dimension vertical and platens 1, 2 are arranged to engage its opposite edges to apply forces to reduce the width of the slab. The upper platen 1 has a slot formed in its lower face so that the upper edge of the slab enters into the slot. The bottom working surface 9 of the slot is inclined and, similarly, the bottom working surface 10 of a slot in the platen 2 is inclined but in the opposite direction to the surface 9.

An anti-buckling restraint R is positioned adjacent that side of the slab 8 from which the surfaces 9, 10 converge.

In use, the inclination of the working surfaces 9, 10 ensure that buckling of the slab 8 will tend to take place but it is in the predetermined direction, as shown in broken lines. This direction is towards the restraint R which then engages the face of the slab and prevents further buckling from taking place.

Referring now to FIGS. 1 to 5, a pressing machine has a pair of platens 1, 2 arranged one above the other. The platen 2 is fixed on a foundation and platen 1 is raised and lowered with respect to the platen 2 by means (not shown).

Figure 2:
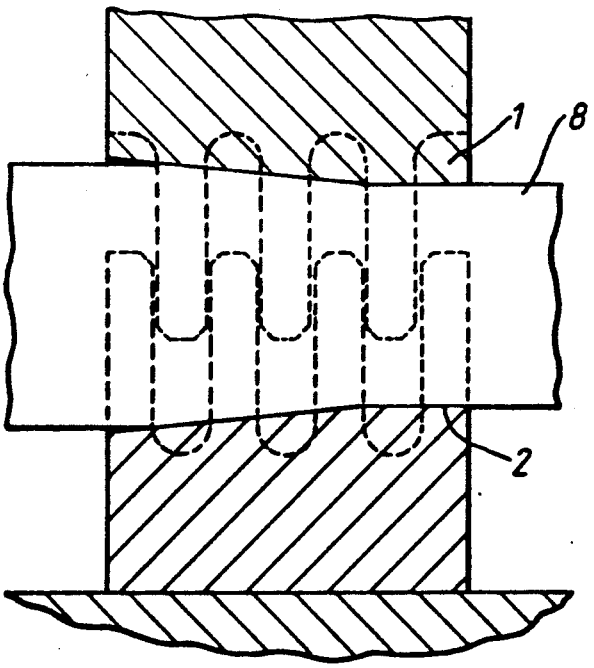
FIG. 2 is a side elevation, similar to FIG. 1, but with the platens displaced relative to each other to apply a pressing force to a slab.

As shown in FIG. 2, a slab 8 having its width dimension vertical is incremented in the direction of its length between the two platens so as to have forces applied by the platens to its respective opposite edges. The forces reduce the width dimension of the slab.

On each of the opposite sides of the platens 1, 2 there is provided a restraint which serves to prevent or, at least, limit the sideways buckling of the slab 8 when the pressing forces are applied to it. The restraint on each side of the platens is in two parts which are connected to respective platens. A plate 3 of substantially the same length as the platen 1 is secured to the platen and the lower edge of the plate 3 is constituted by a number of vertically extending spaced apart fingers 7. In similar manner, a plate 5 of substantially the same length as the lower platen 2 is connected to it and the upper edge of the plate 5 is constituted by a number of spaced apart fingers 7. The plates are aligned so that the fingers 7 on one plate just enter the spaces between the fingers 7 on the other plate. When the upper platen is lowered towards the fixed lower platen, the fingers extend further into the spaces. The plates 3, 5 with their fingers 7 constitute a restraint which severely limits buckling of the slab 8 in one sideways direction and its dimension in the vertical direction is variable. In a similar manner, plates 4, 6 with fingers 7 are fitted on the opposite sides of the platens 1, 2 to serve as a restraint to severely limit buckling of the slab in that sideways direction.

Figure 4:
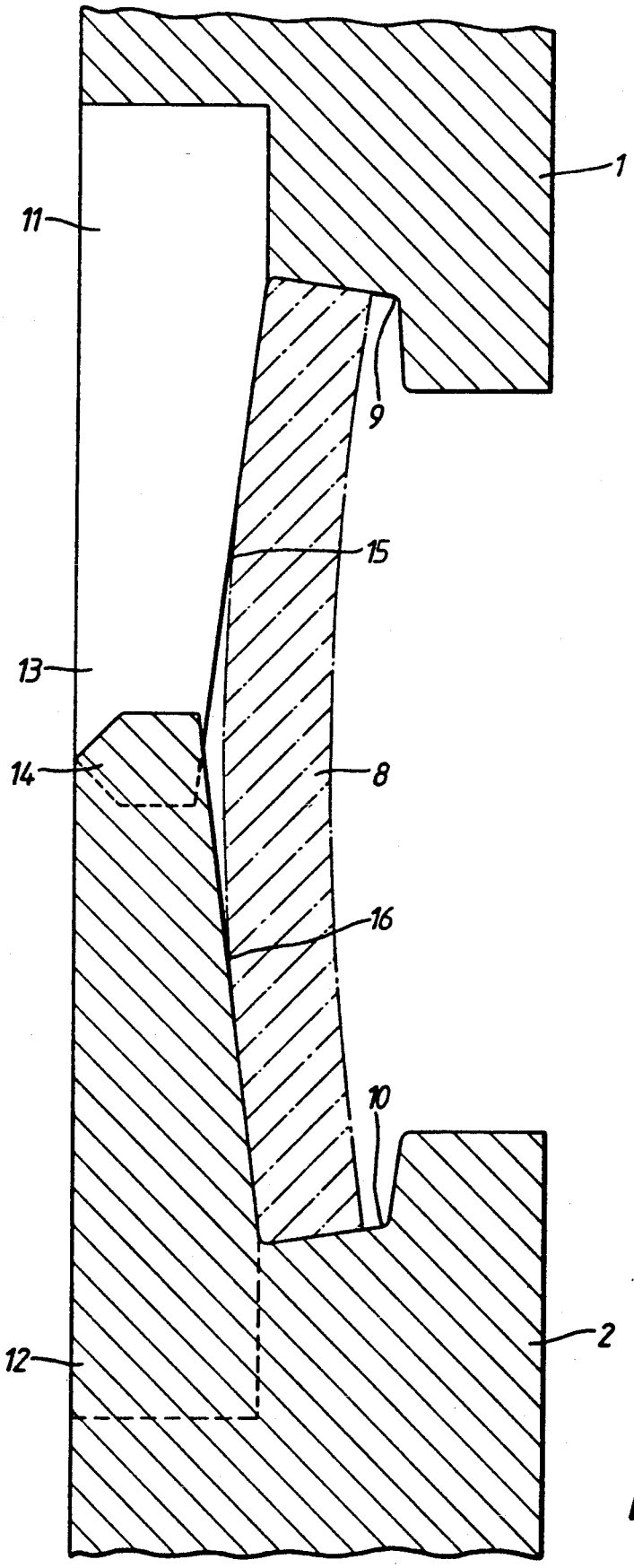
FIG. 4 is an exaggerated enlarged end elevation of the platens.
Figure 5:
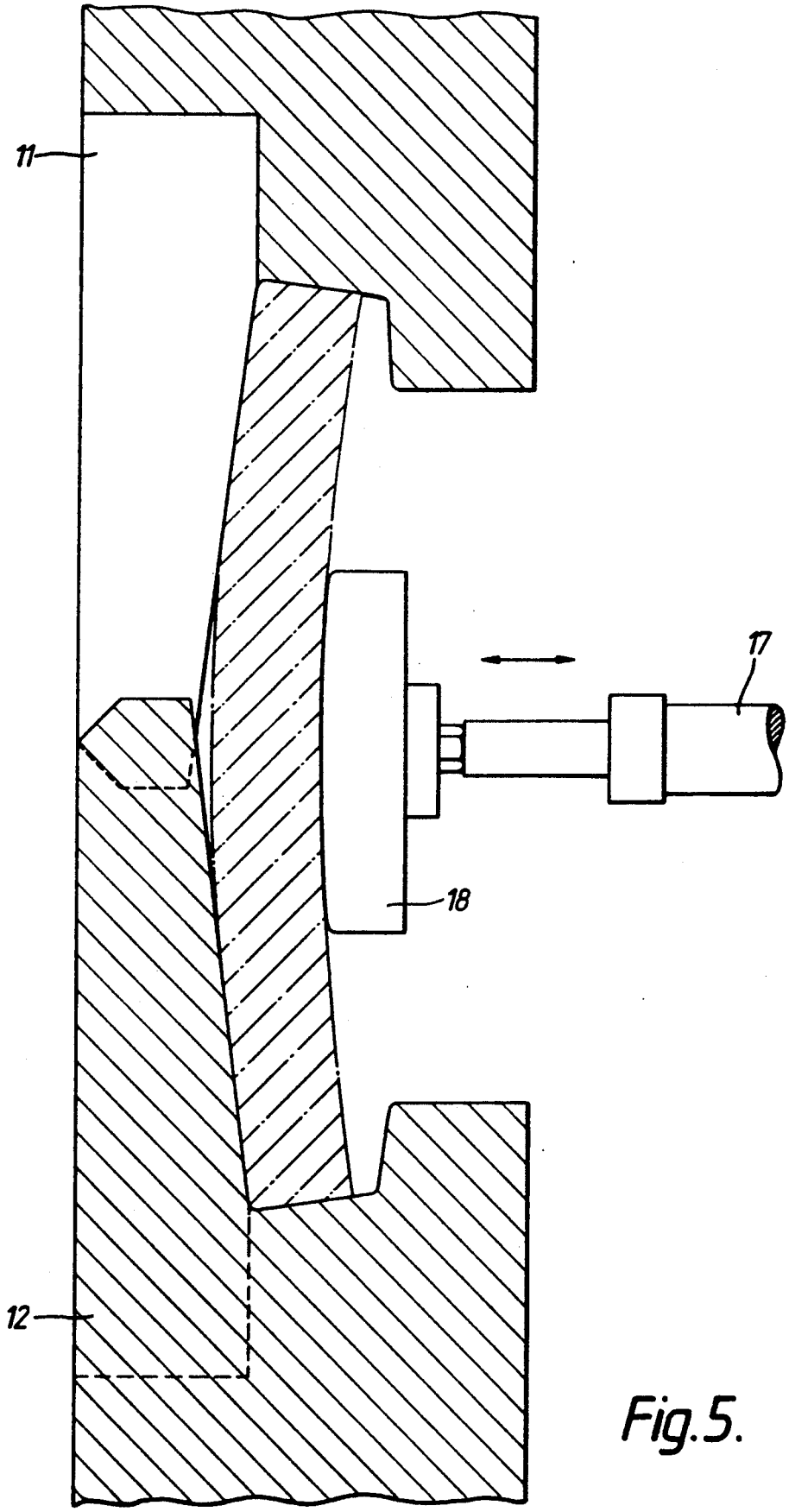
FIG. 5 is an exaggerated enlarged end elevation of the platens and a pressure plate.

Referring now to FIGS. 4 and 5, the platens 1, 2 have inclined or shaped working surfaces 9, 10, respectively, against which the opposite edges of the slab engage. Plates 11, 12 with overlapping fingers 13, 14 are secured to the platens 1, 2 on one side of the line of action of the platens. When the slab 8 is introduced between the platens, and forces are applied to the slab by the action of the platens, the inclined surfaces 9, 10 cause the forces to be applied to the slab such that it is encouraged to buckle sideways towards the plates 11, 12. The inner faces 15, 16 of the vertical fingers are shaped or angled to the vertical so that, as the slab is deformed and buckled by the platens, the slab contacts these inner faces of the fingers and the degree of buckling is limited. As shown in FIG. 5, a pressure may be applied to the slab on that face which is opposite to the plates 11, 12 by means of a hydraulic ram 17 and pressure plate 18 in order to provide further encouragement to the slab to buckle in the direction towards the restraint.

Figure 6:
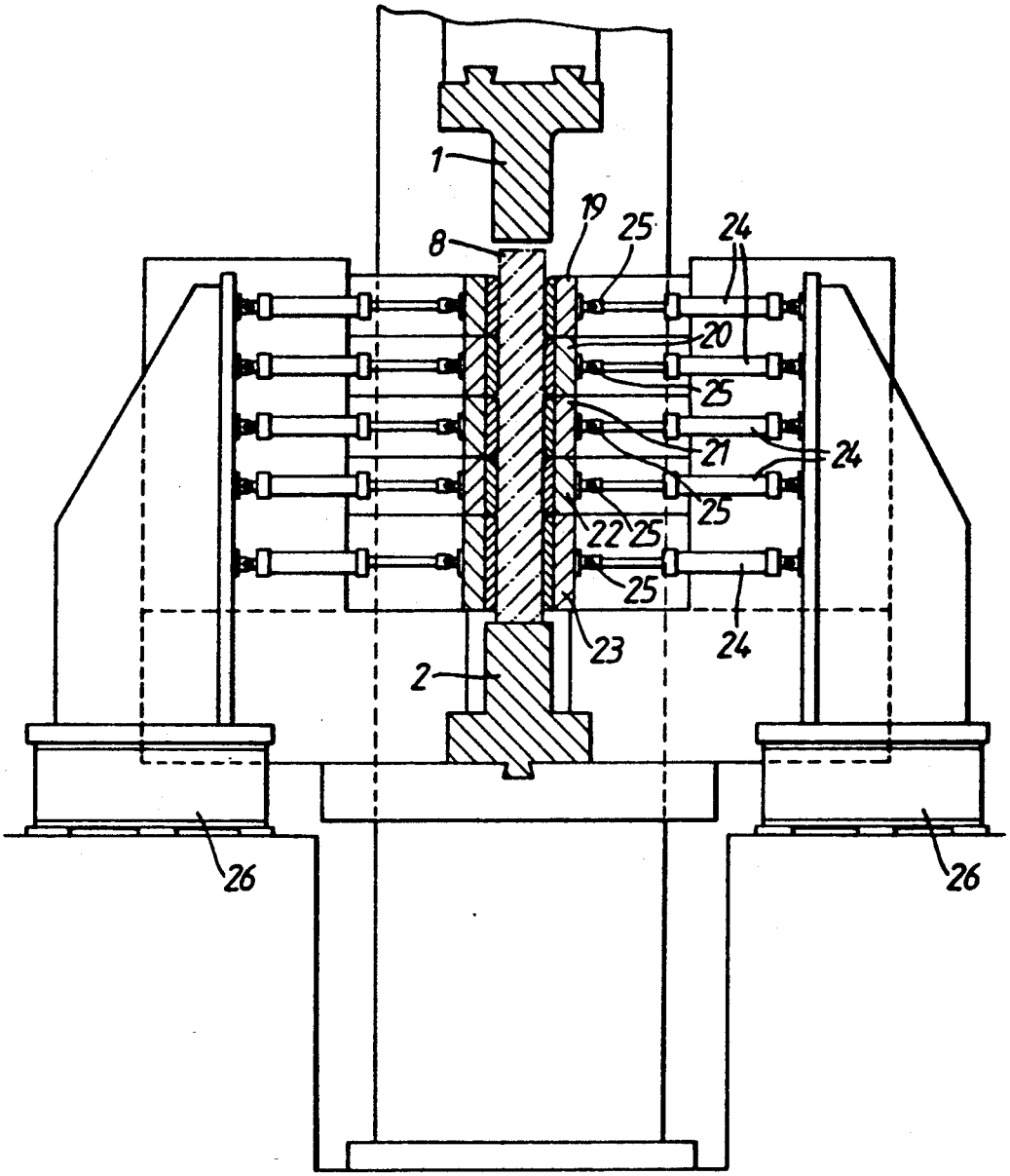
FIG. 6 is an end elevation of a pressing machine in accordance with an alternative embodiment of the invention.
Figure 7:
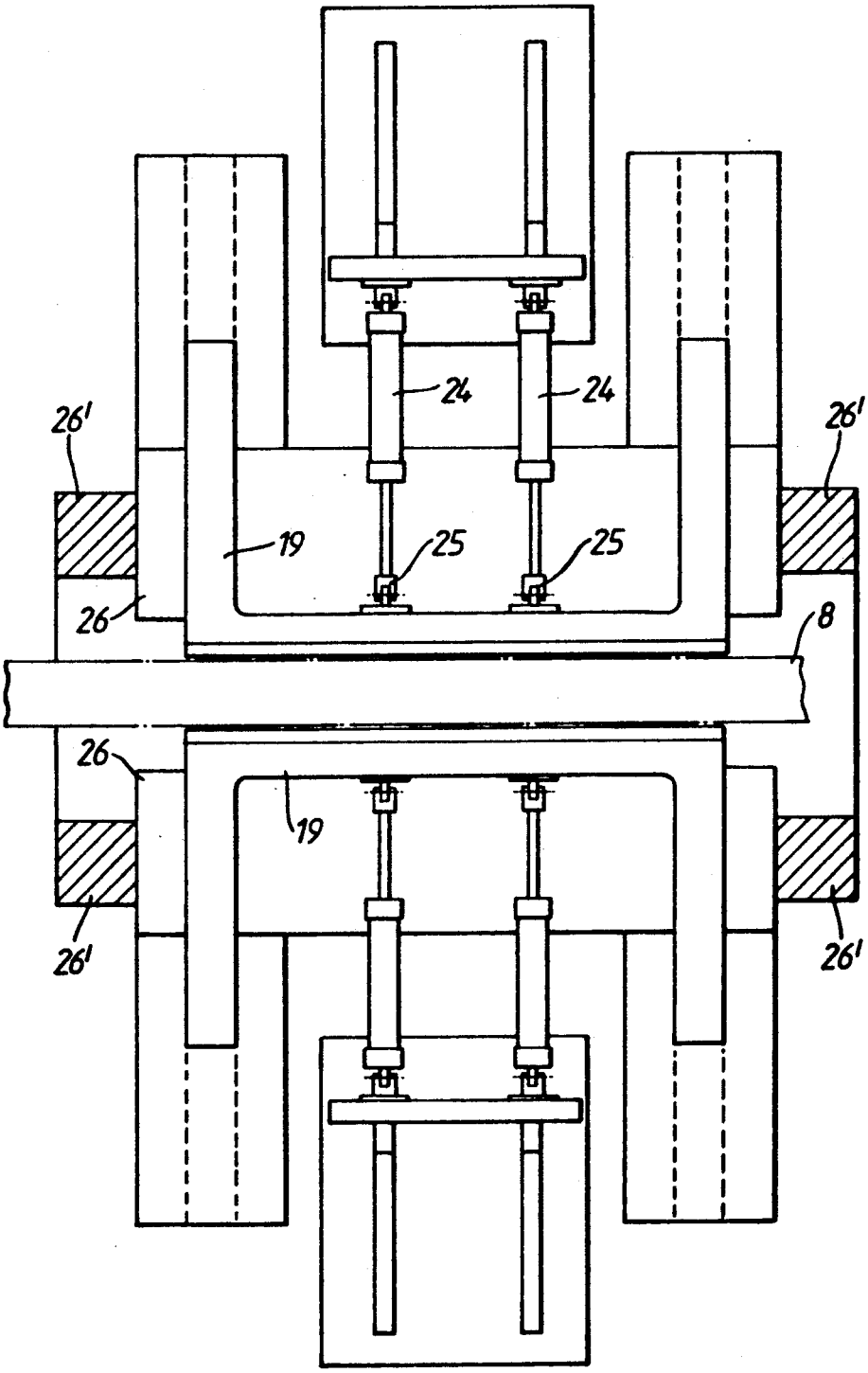
FIG. 7 is a plan on the line 6—6 of FIG. 6.
Figure 8:
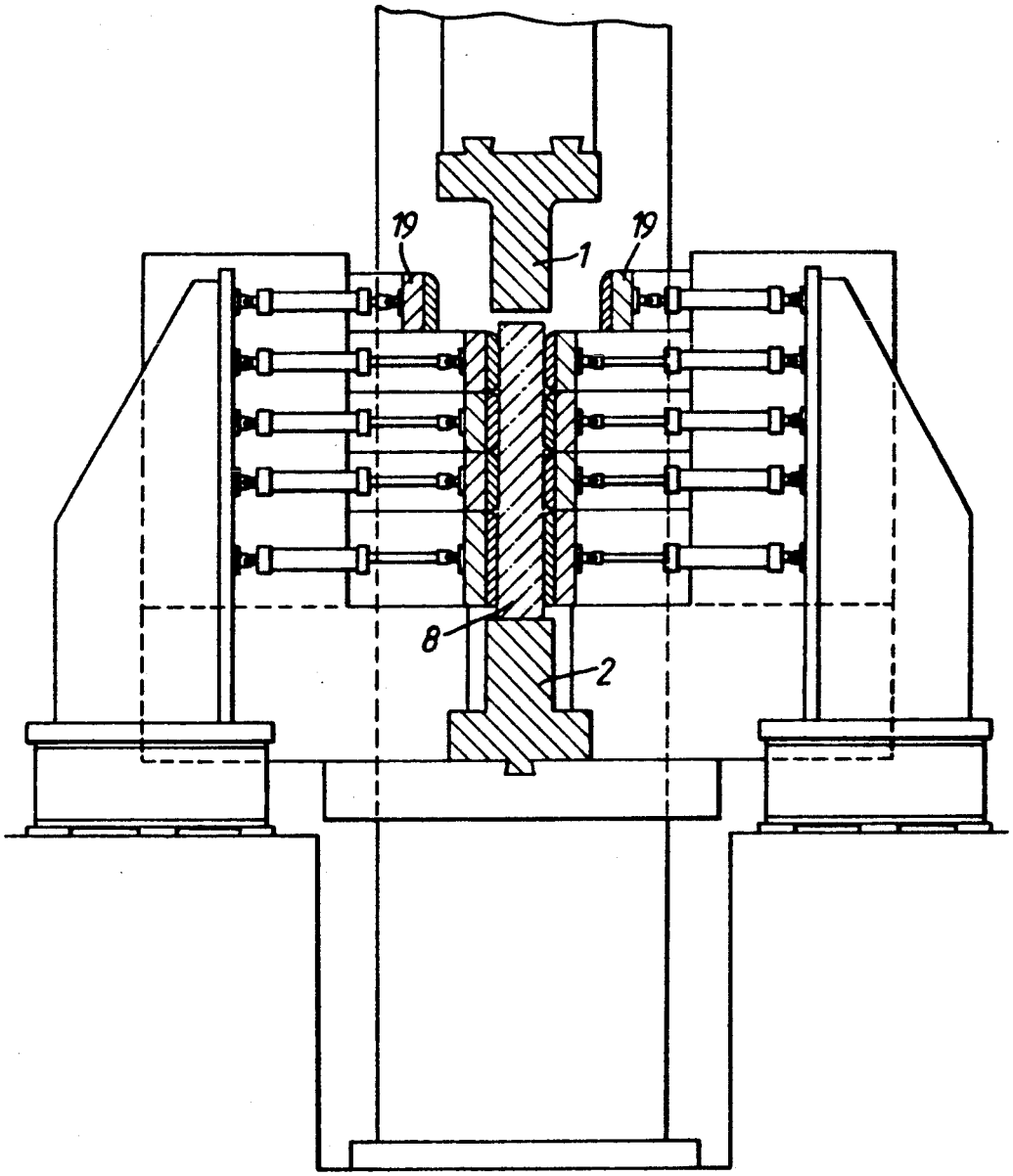
FIG. 8 is a side elevation, similar to FIG. 6.

Referring now to FIGS. 6 to 8 of the drawings, a vertically acting pressing machine has platens 1, 2 and, again, the lower platen 2 is fixed while the upper platen is movable vertically towards and away from the lower platen 2. A slab 8 is shown with its width dimension vertical and with the platens 1, 2 engaging the opposite edges of the slab. Buckling of the slab as its width dimension is reduced is prevented by providing lateral support in the form of a stack of beams 19–23 on each side of the slab. Each beam can be displaced into and out of engagement with the slab by means of a hydraulic ram 24 having a fixed cylinder and its displaceable piston connected to the beam through a clevis joint 25. Each beam extends for substantially the length of the platens 1, 2 and has outwardly extending end portions so that each beam is of channel form in plan, as shown in FIG. 7. The beams are arranged in a stack and are supported on a sub-base 26 which may be secured to the press posts 26' or some other part of the press or mounted separately on a foundation. To accommodate slabs of different thickness, the beams can be displaced sideways and they can also be retracted to a position from beneath the top platen, as indicated in FIG. 8.

The operating sequence is as follows:

With the beams 19–23 in a retracted position, the slab 8 is fed with its width dimension vertical between the platens 1, 2. When the slab is in position, the beams 19–23 are moved to their working position where they are closely positioned to adjacent opposite faces of the slab. The slab is then pressed. The beams are then retracted sufficiently to allow the slab to be incremented forward to a new position in the press and the process is repeated until the whole length of the slab had been pressed. When further reduction is required, it may be necessary to retract the beam 19, which is at the top of the stack, outwardly from beneath the platen so that further pressing can be applied to the slab.

Slabs which initially have different width dimensions can be accommodated in the press and the restraints can be varied by removing or adding one or more beams to the stack to accommodate the beam. It is convenient for the vertical dimension of the beams at the top of the stack to be less than those at the bottom of the stack so that small differences in the vertical dimension of the slab can be accommodated simply by adding or removing the minimum number of beams.

Allowance must be made for the slab to increase in thickness when its width is reduced during pressing. Large width reductions will cause increases in thickness which may be of the order of 10% and so a slab 250 mm thick will suffer a thickness change of the order of 25 mm. This change in thickness must be accommodated by the support beams.

One way to achieve this is as follows:

a) the support beams 19–23 on one side of the slab are moved to a datum position so that they are close to or in contact with the slab. The beams are held in this position by closing the valve which allows oil to flow to or from the actuating jacks 24. Position control by hydraulic jacks is well known;

b) the beams 19–23 on the other side of the slab are then moved into contact with the slab and the pressure inside the jacks is allowed to increase until a chosen preset pressure or load is developed and held. Pressure control of hydraulic jacks is well known. The fixed jacks react against this preset load. The preset load is chosen to be sufficient to prevent sideways deflection and buckling of the slab, but is well below a load which would prevent thickening of the slab during pressing;

c) the slab is then pressed. One set of beams remains fixed, the other set under constant load are pushed back as the slab thickens. The slab cannot buckle;

d) after pressing, the jacks are retracted clear of the slab by a small amount to permit the slab to be moved along ready for a repeat of the whole sequence and so on until the entire slab has been pressed.

Figure 9:
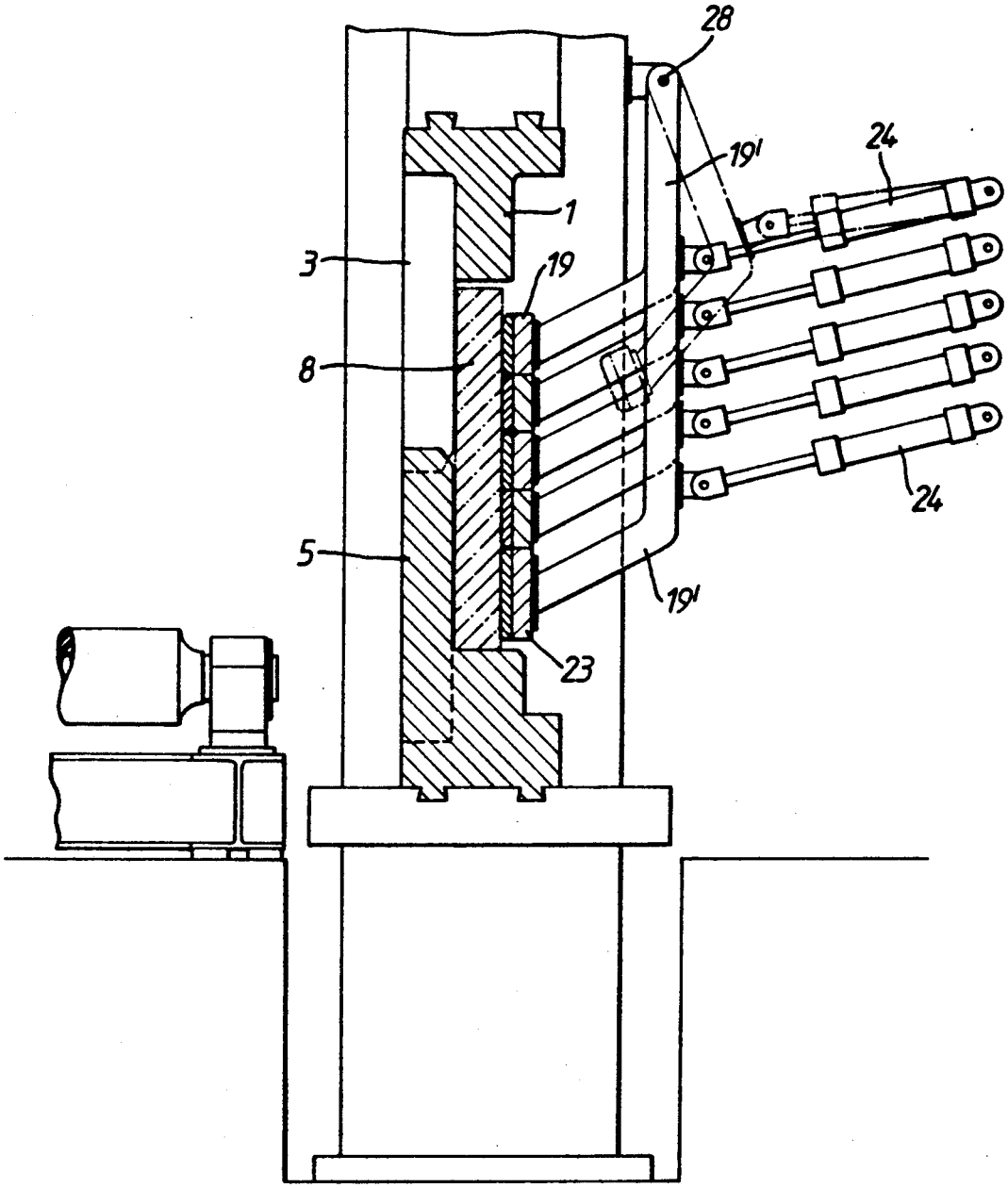
FIG. 9 is a diagrammatic end elevation showing an alternative to the arrangement shown in FIG. 6.

FIG. 9 shows an arrangement where each of the beams 19–23 in one stack are mounted on separate cranked levers 19'. Each lever is pivoted at one end about a common pivot 28 and the rams 24 are connected to the pivoted levers. In this way, the beams are held in their work position and can be swung out from beneath the platen 1 to a retracted position, shown in broken lines in FIG. 9. The beams of both stacks could be similarly mounted.

Figure 1:
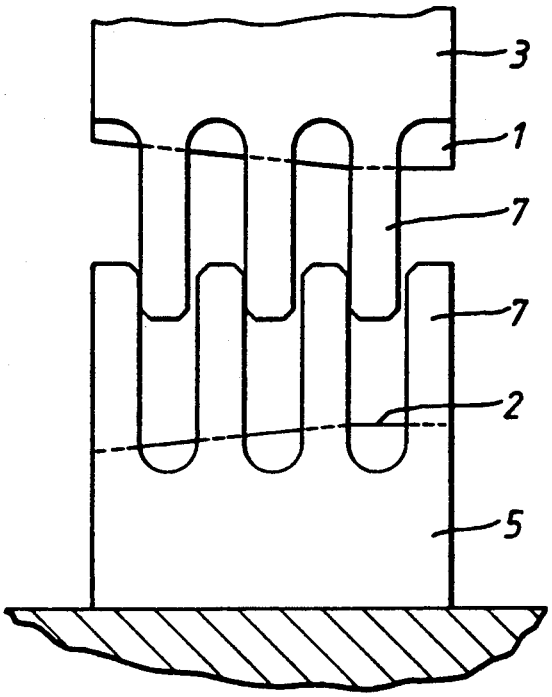
FIG. 1 is a side elevation of the platens of a pressing machine.
Figure 3:
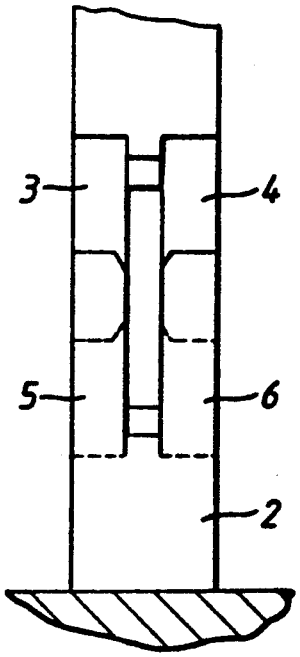
FIG. 3 is an end elevation of the platens.

In the arrangement shown in FIG. 9, the restraint on the left-hand side of the slab 8 is in the form of overlapping plates 3, 5, as shown in FIGS. 1 to 3.

Figure 10:
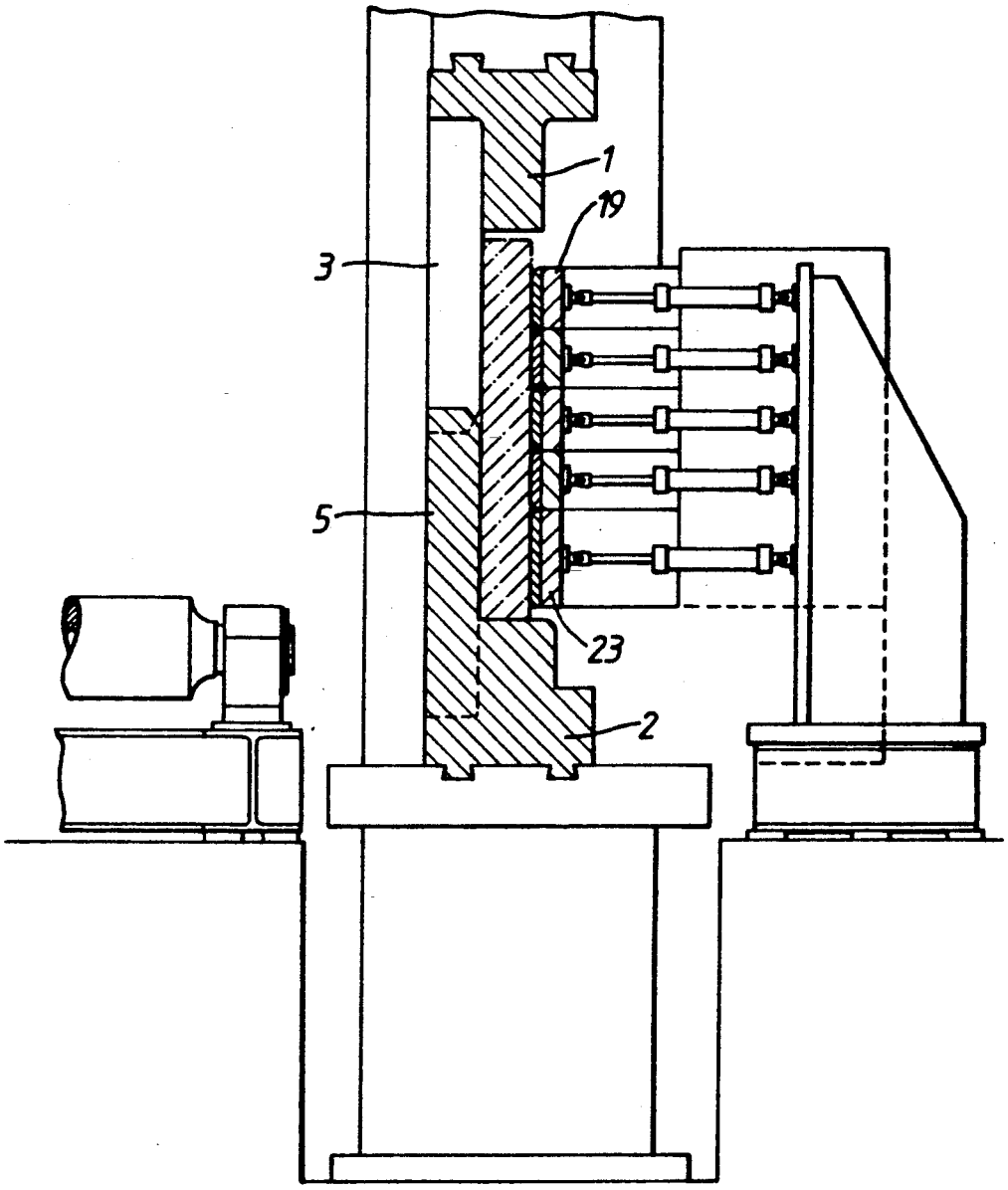
FIG. 10 is an end elevation showing a further alternative to the arrangement shown in FIG. 6.

FIG. 10 shows an arrangement where the pressure plate 18 shown in FIG. 5 is replaced by a stack of beams of the form shown in FIGS. 6 to 8.

A further feature of the invention is to provide pads on that face of each of the support beams which contacts the slab. These pads can be replaced when worn. The pads have low thermal conductivity and minimise heating and thermal distortion of the beams and minimise heat losses from the slab.

We claim:

1. A pressing machine comprising two platens positioned one above the other with at least one of said platens being reciprocatable vertically with respect to the other platen;

means to incrementally feed a hot elongate metal slab in the direction of its length with its width dimension extending substantially vertical and its thickness dimension extending substantially horizontal between the platens so that the platens are engageable with respective upper and lower opposite sides of the slab;

a restraint positioned adjacent to, and horizontally to one side of, the portion of the slab which, in use, is being pressed between the platens so as to control the buckling of the slab in the horizontal direction towards the restraint, the vertical dimension of the restraint being substantially equal to the width dimension of said portion of the slab and being variable so as to accommodate slabs which, before pressing, are of different width dimensions;

and whereby, as a hot elongate metal slab is incrementally fed between the platens, at least said one platen is vertically reciprocated during successive feeding of the slab to cause the platens to engage said upper and lower opposite sides of the slab to reduce the width dimension of the slab and the buckling of the portion of the slab which is being pressed is controlled by the restraint.

2. A pressing machine as claimed in claim 1, wherein the parts of the first and second platens which engage the respective opposite edges of the slab are so shaped as to encourage the slab to buckle in the direction towards the restraint.

3. A pressing machine as claimed in claim 2, wherein the parts of the first and second platens which engage the slab comprise working surfaces which are non-parallel and which diverge in the direction towards the restraint.

4. A pressing machine as claimed in claim 1 wherein means are provided to engage the face of the slab which is opposite that adjacent the restraint to encourage the slab to buckle in the direction towards the restraint.

5. A pressing machine as claimed in claim 4, wherein said means comprise a pressure plate mounted on a hydraulic ram.

6. A pressing machine as claimed in claim 1, wherein the restraint is in two parts which are connected to respective platens.

7. A pressing machine as claimed in claim 6, wherein each part is in the form of a plate having spaced apart fingers projecting therefrom, the fingers on each part being arranged to enter into spaces between the fingers on the other part to enable the dimension of the restraint to be varied.

8. A pressing machine as claimed in claim 1, wherein the restraint comprises at least two beams arranged in a vertical stack with each beam having a separately operable ram associated with it to displace the beam from a withdrawn position to a desired position adjacent the face of the slab and to retain the beam in that position.

9. A pressing machine as claimed in claim 8, wherein the surface of each beam adjacent to the slab is provided by a replaceable pad of a material of lower thermal conductivity than that of the beam.

10. A pressing machine as claimed in claim 1, wherein two restraints are provided, said restraints, in use, being adjacent opposite faces of the slab.

11. A pressing machine as claimed in claim 10, wherein each restraint is in two parts which are connected to respective platens.

12. A pressing machine as claimed in claim 10, wherein each restraint comprises at least two beams arranged in a vertical stack with each beam having a separately operable ram associated with it to displace the beam from a withdrawn position to a desired position adjacent the face of the slab and to retain the beam in that position.

13. A pressing machine as claimed in claim 10, wherein one restraint is in two parts which are connected to respective platens and the other restraint comprises at least two beams arranged in a vertical stack with each beam having a separately operable ram associated with it to displace the beam from a withdrawn position to a desired position adjacent the face of the slab and to retain the beam in that position.

* * * * *